US009790623B2

(12) United States Patent
Brenk et al.

(10) Patent No.: US 9,790,623 B2
(45) Date of Patent: Oct. 17, 2017

(54) DEVICE FOR CONTINUOUSLY PROCESSING A THREAD-LIKE MATERIAL

(71) Applicant: Saurer Germany GmbH & Co. KG, Remscheid (DE)

(72) Inventors: Siegfried Brenk, Krefeld (DE); Ingo Filz, Viersen (DE); Jurgen Schnitzler, Viersen (DE); Georg Tetzlaff, Aachen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 456 days.

(21) Appl. No.: 14/558,259

(22) Filed: Dec. 2, 2014

(65) Prior Publication Data

US 2015/0152577 A1 Jun. 4, 2015

(30) Foreign Application Priority Data

Dec. 3, 2013 (DE) ..... 10 2013 020 471

(51) Int. Cl.
*D02J 13/00* (2006.01)
*D06B 17/02* (2006.01)
(Continued)

(52) U.S. Cl.
CPC ..... *D02J 13/00* (2013.01); *D02G 1/12* (2013.01); *D02G 1/205* (2013.01); *D02J 11/00* (2013.01);
(Continued)

(58) Field of Classification Search
CPC ..... D02G 1/12; D02G 1/125; D02G 1/127; D02G 1/20; D02G 1/205; D02G 1/004;
(Continued)

(56) References Cited

U.S. PATENT DOCUMENTS 2,854,701 A 10/1958 Rainard
2,865,080 A * 12/1958 Hentschel ..... D02G 1/12 19/66 R
(Continued)

FOREIGN PATENT DOCUMENTS

CH 433 172 A 4/1967
CH 537 485 A 5/1973
(Continued)

OTHER PUBLICATIONS

European Search Report issued in corresponding European Application No. 14003923.1, dated May 8, 2015.
(Continued)

*Primary Examiner* — Amy Vanatta
(74) *Attorney, Agent, or Firm* — Nelson Mullins Riley & Scarborough LLP

(57) ABSTRACT

A method for continuously processing a thread-like material with a plurality of method steps and a device for carrying out the method, wherein a feed mechanism (10), a treating (35) and depositing device (36), a transporting device (14), a thermosetting mechanism (32) and a length compensating mechanism (37) are arranged in a common closed system (5) and the closed system (5) differs from the surroundings in its interior by at least one first physical property and sub-systems (31, 32, 33, 35, 36, 37) that are shielded from one another are present within the system (5) for the various method steps, to which sub-systems supply mechanisms (25, 26, 27) are connected, which produce at least partially different temperatures in the sub-systems (31, 32, 33, 35, 36, 37) as the second physical property.

15 Claims, 4 Drawing Sheets

(51) Int. Cl.

| | |
|---|---|
| ***D02G 1/20*** | (2006.01) |
| ***D02G 1/12*** | (2006.01) |
| ***D02J 11/00*** | (2006.01) |
| ***D06B 3/04*** | (2006.01) |

(52) U.S. Cl.
CPC ..... *D02J 13/001* (2013.01); *D06B 3/045* (2013.01); *D06B 17/02* (2013.01)

(58) Field of Classification Search
CPC . D02G 1/02; D02G 1/0213; D02J 1/02; D02J 11/00; D02J 13/00; D02J 13/001; D02J 1/00; D02J 1/06; D02J 1/22; D02J 1/221; D02J 1/222; D02J 1/228; D02J 1/229; D06B 17/02; D06B 3/045; D06B 21/00; D06B 23/14; D06B 23/16; G01H 1/00; G01H 1/14; G01H 1/16; G01H 13/00
See application file for complete search history.

(56) References Cited

U.S. PATENT DOCUMENTS

| | | | | | |
|---|---|---|---|---|---|
| 2,917,785 | A | * | 12/1959 | Gibson | D02G 1/12 28/263 |
| 3,058,167 | A | | 10/1962 | Rainard et al. | |
| 3,259,953 | A | * | 7/1966 | Baer | D02G 1/12 19/66 R |
| 3,659,439 | A | | 5/1972 | Tindall | |
| 3,703,754 | A | * | 11/1972 | Blanc | B05B 13/02 28/255 |
| 3,906,755 | A | | 9/1975 | Sando et al. | |
| 4,261,084 | A | * | 4/1981 | Kayser | D02G 1/12 28/255 |
| 4,760,629 | A | | 8/1988 | Paulini et al. | |
| 5,575,048 | A | * | 11/1996 | Ruef | D02J 13/006 28/219 |
| 5,943,748 | A | | 8/1999 | Steiner et al. | |
| 7,997,055 | B2 | | 8/2011 | Brenk | |
| 2011/0283748 | A1 | * | 11/2011 | Brenk | D02J 13/001 68/5 E |
| 2016/0040324 | A1 | * | 2/2016 | Beckers | D06C 7/02 68/5 D |

FOREIGN PATENT DOCUMENTS

| | | | | |
|---|---|---|---|---|
| DE | 1154 898 | B | | 9/1963 |
| DE | 1410 357 | B2 | | 10/1968 |
| DE | 1 635 125 | A1 | | 1/1971 |
| DE | 198 25 905 | A1 | | 3/1999 |
| DE | 10 2006 040 065 | A1 | | 2/2008 |
| DE | 10 2007 014 556 | A1 | | 10/2008 |
| EP | 0 222 214 | A2 | | 5/1987 |
| EP | 1348785 | A1 | * | 10/2003 |
| GB | 1077525 | | | 8/1967 |
| JP | 52128418 | A | | 10/1977 |
| WO | 2008025411 | A1 | | 3/2008 |

OTHER PUBLICATIONS

German Search Report for priority German Patent Application No. DE 10 2013 020 471.2, dated Oct. 8, 2014.

* cited by examiner

DEVICE FOR CONTINUOUSLY PROCESSING A THREAD-LIKE MATERIAL

CROSS-REFERENCE TO RELATED APPLICATIONS

This application claims priority from German National Patent Application No. 10 2013 020 471.2, filed Dec. 3, 2013, entitled "Verfahren and Vorrichtung zur Kontinuierlichen Bearbeitung eines Fadenformigen Gutes," the entire contents of which is incorporated herein by reference.

FIELD OF THE INVENTION

The invention relates to a method for continuously processing a thread-like material with a plurality of method steps and a device for carrying out the method.

BACKGROUND OF THE INVENTION

So that textiles fulfil their purpose of use and have the desired properties with respect to feel, appearance and use behaviour, they are specially processed. Apart from obtaining the fiber, yarn and twist production and the fabric production, there are further methods that influence the textile properties.

For example, a greater stability or more volume in the thread-like material, an increase in the temperature-resistance, a dyeing, a water-repellent or fungicidal finish are necessary, to only mention a few examples, depending on the purpose of use.

These so-called finishing methods can be carried out in all the process stages; there are finishing methods for fibers, yarns/twists and fabrics. Some finishing methods can be integrated into the production or further processing process but others are in turn discontinuous.

Many of these finishing methods require a subsequent thermal setting, which is generally carried out in a steam atmosphere or under dry heat in order to permanently stabilise the desired properties. Generally, the setting process is called thermosetting in the textile industry but in carpet yarn production the synonym heat-set process is used.

For example, in the area of carpet yarn production there are so-called straight set yarns and frieze yarns.

In straight set yarn, the straight linear structure of the single yarns or the cabled yarns or twists are thermoset, which in cut-pile carpets leads to straight pile loops arranged next to one another.

A three-dimensional forming is overlaid on the yarn in a separate process for frieze yarns between the cabling process and the heat-set process. In this case, the yarn is three-dimensionally formed by bending/compression and this state is thermoset. The yarns in the finished carpeting are formed like a walking stick in the case of cut-pile carpeting. These carpets have a lively surface structure, which is non-sensitive to footprints. More than half of the cabled yarns or twists processed in cut loop tufted carpets worldwide are given a so-called frieze appearance or textured appearance in a thermo-mechanical process.

After the forming, the cabled yarns or twists are subjected to a subsequent thermosetting process. Owing to the successive heating and cooling, the yarn relaxes and can shrink and bulk depending on the type of material. A maximum bulk is generally desired and for this the thread has to run through the thermosetting mechanism free of tension, in particular free of tensile stress and compressive stress. Furthermore, the yarn twist is permanently stabilised or set thereby, which, in the later use of the yarns, leads to a substantially improved wear-resistance and durability of the carpets or carpeting produced therefrom.

In practice, these methods are carried out by individual units that are independent of one another.

A thread finishing system is described in German Patent Publication DE 198 25 905 A1. Depending on whether a crimped or uncrimped thread is to be produced, it runs through a corresponding alternative unit and is deposited on a conveyor belt. On the conveyor belt, the thread is finally fed to an air-conditioning chamber for thermosetting. As different units are used to produce crimped or uncrimped threads, an adapter arranged downstream of the delivery roller is disclosed, which reduces the assembly outlay to convert the finishing system.

According to German Patent Publication DE 198 25 905 A1, a so-called compression chamber is used in order to be able to produce crimped threads (in the textile branch the terms compressed, formed threads or threads with a frieze effect are used as synonyms). The compression chamber, apart from a channel inlet and a channel outlet, has a through-channel. A so-called retaining flap, which exerts a retaining force counter to the transporting direction of the threads to be compressed, is arranged at the channel outlet with a joint on the channel wall. The threads to be compressed, via the channel inlet, reach the through-channel and are braked here on the walls of the through-channel and by the retaining flap until the yarn plug is so large that the retaining force of the retaining flap is overcome and threads come to rest via a sliding face arranged downstream of the channel outlet on a conveyor belt. Following this, the threads are fed on a conveyor belt to a separate thermosetting mechanism.

If, on the other hand, non-crimped threads or straight set yarns or twists are to be produced, a so-called loop depositor is necessary for this. The loop depositor contains a hollow shaft, into which a depositing tube projects. Together with the hollow shaft, the depositing tube can be driven to traverse. The threads, which are fed by the delivery roller pair, arrive through an inlet tube in a through-channel and finally in the channel of the traversing depositing tube so the threads are deposited in the form of thread loops on a conveyor belt in order to thereafter run through a separate thermosetting mechanism. Ignoring the bending radii, non-crimped or straight set threads are referred to.

A method for thermally treating a running yarn and a twisting machine for carrying out the method are known from German Patent Publication DE 10 2006 040 065 A1. For this purpose, each workstation has a steam setting mechanism, which can be driven by saturated steam or hot steam and is used for setting the yarn drawn off from the twisting mechanism.

The inlet and outlet openings have thread sluices, which are used to seal the thread treating chamber toward the surroundings. Such thread sluices are important components of yarn treating chambers of this type as, on the one hand, during operation, an efficient seal has to be ensured by the yarn that is running through and, on the other hand, the friction of the yarn that is running through should be as small as possible. The guidance of the yarn through the device is achieved in each case by a delivery mechanism arranged upstream of the device and one arranged downstream of the device. For this purpose, the two delivery mechanisms of the respective workstation are activated in such a way that the yarn running through the device runs through substantially tension-free. The yarn is wound onto a bobbin directly after leaving the treatment device.

The drawback in the method and the device is, however, that to set an effect, this individual unit has to be arranged downstream of another unit, which, for example, produces a frieze effect, so a relatively large installation space is required.

German Patent Publication DE 10 2007 014 556 A1, according to the title, discloses a combination of a method for producing frieze yarn with a cabling or twisting machine or integration of this method in a cabling and twisting machine connected to a heat-set unit. For this purpose, the textile yarn is firstly subjected to the cabling or twisting process, then the frieze effect is produced and thereafter the textile yarn thus formed is set in the heat-set unit. The device for frieze production may be arranged here in front of the heat-set mechanism or integrated in the heat-set mechanism. All the three method steps are to be combined in one machine.

Further specific design features are not contained in this publication.

The drawback in the method is that the proposed rigid integration of all the units in one machine reduces the flexibility of this procedure as exclusively yarn with a frieze effect can be produced using this cabling or twisting machine. In addition, high setting temperatures prevail in the compression chamber of the frieze unit and the heat-set unit if the frieze mechanism is integrated in the heat-set mechanism. However, if the setting temperature already acts during the compression of the thread on the retaining flap of the compression chamber, pressure points of the crossing thread layers, which are caused by the compression are produced and are also set. These pressure points impair the uniformity of the yarn, which, for example during dyeing, and therefore in the later fabric, leads to a non-uniform fabric appearance.

Furthermore, only a restricted bulking of the yarn, which is necessary to increase the volume, can be produced in this manner.

SUMMARY OF THE INVENTION

An object of the present invention is accordingly to propose a method, which reduces or eliminates the drawbacks mentioned above, and a device for carrying out the method. The flexibility is thus to be increased, energy saved and the quality of the product improved.

This object is achieved according to the invention by a method wherein the thread-like material is deposited by means of a feed mechanism and a treating and depositing device on a transporting mechanism to pass a thermosetting mechanism and, after the thermosetting, runs through a length compensating mechanism to ensure a uniform further processing, the different method steps being carried out in a closed system, which, in its interior, differs from the surroundings with respect to at least one first physical property, and in that at least two method steps in turn differ from one another with respect to a second physical property.

A main feature of this method is that all the method steps mentioned take place in a space volume separated from the atmosphere. For this purpose, the closed system according to the invention is limited by a housing.

A thread-like material in the framework of this application is to be taken to mean all linear strands and fabrics. These may be yarns, twists or else film tapes as well as tubular and tape-like textiles and the like. For simplification, the term thread is used synonymously for the possible alternatives in the framework of this application.

According to a feature of the method, the closed system differs in its interior from the surroundings owing to substantially the same pressure.

The different method steps are carried out in a closed system, which has a higher pressure compared to the atmosphere. As the system has substantially the same pressure, only the external housing with respect to its stability has to take on the pressure difference of the ambient atmosphere to the internal system pressure Almost no pressure difference acts on the wall of the steam zone, which makes substantially smaller wall thicknesses possible in the structural configuration for the steam zone.

The thermosetting zone now no longer has to be sealed at the inlet and at the outlet of the conveyor belt against pressure differences, as both—conveyor belt and thermosetting zone—are a component of the closed system. The use of squeeze rollers, which is currently conventional in practice, can therefore be dispensed with. Thus, the disadvantages of squeeze rollers, such as, for example, pressure points at crossing points of a plurality of thread layers and dyeing differences resulting therefrom, are avoided, in particular when the squeeze rollers come into contact with threads that have not yet completely cooled.

According to another feature of the method, the second physical property is the temperature. Conventional system pressures are produced from the method temperature that is typical for the material for thermosetting which, depending on the material, for example for saturated steam as the setting medium, is generally in the range between 110° C. and 150° C.

The different method steps may optionally also differ with respect to their air humidity. A further, possible variant is that the entire system has virtually the same air humidity, which then, however, differs from the outer surroundings.

The present invention also provides a device for carrying out the method, in which a feed mechanism, a treating and depositing device, a transporting device, a thermosetting mechanism and a length compensating mechanism are arranged in a common closed system, the closed system differs in its interior from the surroundings by at least one first physical property and sub-systems that are shielded in relation to one another are present within the system for the various method steps, supply systems, which produce at least partly different temperatures as the second physical property in the sub-systems, being attached to said sub-systems.

The basic idea of the invention is to be able to carry out the treating to provide an effect as well as the thermosetting within a closed system, all the mechanisms for providing an effect or shaping, for the proper depositing of the thread, for the transportation of the thread through the temperature zones and for the controlled thread storage for length compensation being located within system limits and the thermosetting unit preferably being operated with saturated steam, in other words under a high pressure corresponding to the temperature.

The closed system has sub-systems here, such as, for example, a sub-system compressed air zone, a sub-system steam zone and a sub-system cooling zone.

The sub-system effect production and thread depositing on a conveyor belt, which works in the system pressure, is arranged in the sub-system pressure air zone, which, depending on the requirement, can be adjusted with a higher temperature than the preheating zone or optionally also with a compressed air/steam mixture.

In order to achieve specific effects, the thread is treated. In this case, depending on the requirement profile, there are a large number of desirable properties, which can be applied to the thread. The treatment device may, for example, form the thread or contain a printer, which continuously prints the thread. The treatment may, however, also consist in the thread being guided within the treatment device through a liquor, which gives the thread, for example, hydrophobic, antistatic or fungicidal properties.

In order to avoid pressure points when producing, for example, frieze yarn, it is important for a lower temperature to prevail both in the compression chamber and during the depositing of the thread on the conveyor belt than in the subsequent steam zone. During compression of the thread plug on the retaining flap, pressure points would otherwise be produced at the crossing regions of the thread, which can no longer be compensated and are expressed, for example, by different dyeing behaviour.

The temperature gradient between the compressed air zone and steam zone also assists the result to be achieved during the production of straight yarns.

The conveyor belt transports the deposited thread at a defined speed through a shield into the steam zone. The heating takes place there to the so-called thermosetting temperature or bulking temperature and the thread undergoes a shrinkage and bulking due to the material.

As already mentioned, the system pressures are produced from the method temperatures for the thermosetting, which are specific to the material. If, for example, saturated steam is used as the setting medium, these are generally in the range between 110° C. and 150° C.

In the following sub-system cooling zone, the thread is cooled with a target value below the glass transition temperature by means of compressed air so that the state present in the steam zone is permanently stabilised or set and therefore becomes resistant to mechanical loads in the following processes and in the finished carpet. The sub-system thread store with delooper may additionally be located in the cooling zone.

As a shield between different temperature zones is substantially less problematical and structurally easier to achieve than the delimitation of different pressure zones, it is sufficient to use corresponding mechanical separating elements to stabilise the steam zone, in the simplest case a slotted screen or a rigid elongate gap, and the loading of the upstream or downstream zone with compressed air and a pressure substantially corresponding to the steam pressure. Both ensure a low exchange of media between the individual zones.

Moreover, all the known means for shielding are basically conceivable here, however, such as, for example, a roller against a roller or a roller against a belt.

According to an aspect of the device, the closed system has means to produce substantially the same pressure in the interior, which differs from the surroundings.

As already mentioned, the inner walls can thereby be made thinner and only the wall of the external housing has to be made thicker in order to be resistant to the pressure difference of the ambient atmosphere to the internal system pressure.

Furthermore, according to another aspect of the device, the limits of the system, at which the thread-like material enters or exits, are formed by sluices, which suppress a pressure compensation with the surroundings. Temperature shields are only present at the limits of the sub-systems with one another.

The entire pressure space is only sealed with respect to the surroundings at the thread entry and thread exit by means of sluices, in the simplest case straight tubes, which are matched to the respective diameter of the thread with respect to minimum leakage and a yarn throughput free of disruption. Instead of yarn sluices, other known separating means can also be used for sealing, such as, for example, squeeze rollers.

Substantially the same pressure and different temperature zones are located within the system.

The housing is only interrupted by the thread inlet and outlet and the feed and discharge lines of the media flows necessary for operation for saturated steam, air and condensates.

The treatment device is a shaping mechanism in a preferred embodiment of the device.

A more voluminous or formed appearance is given to the yarn, in particular in the area of carpet yarn production, after the cabling or twisting.

According to a further feature of the device, the treatment device is a combined device for producing a frieze effect or alternatively a straight set effect.

So that the corresponding treatment device does not always have to be disassembled, exchanged and installed again when changing from straight set yarns to frieze yarns or vice versa, a device can be used here, with which both frieze yarns, i.e. with a three-dimensional shaping, and straight set yarns, i.e. in the elongated state, can be produced. To change from one method to the other, no rethreading or knotting of the threads has to be carried out here.

As already described, the frieze device is, for example, configured as a compression chamber. In this case, the thread is conveyed by the delivery mechanism into a chamber, in which a wall segment is placed under load (for example by spring force or compressed air) and closes the space. A thread plug is formed against the force-loaded retaining flap, said thread plug leaving the compression chamber again as soon as the plug pressure exceeds the counterforce of the retaining flap. The level of the retaining flap resistance determines the intensity here of the three-dimensional forming formed in the plug, i.e. the intensity of the frieze character. The intensity of the frieze character is influenced by means of changing the retaining flap force.

The formed frieze yarn is deposited in a controlled manner by means of a funnel-like element, for example a tube elbow, the outlet opening of which is fixed and points in the direction of the transporting mechanism. In this case, the frieze yarn formed slides down under its own weight and as a result of the continuous replenishment in the interior of the tube elbow and is placed on the running conveyor belt.

When there is a change to produce straight set yarn, the retaining flap is placed in the rear position by means of a suitable activation and remains there for the entire production time. An obstacle-free chamber, through which the thread runs without deflection, is thus produced.

At the same time, the funnel-like element is rotatably driven by means of a drive, for example a stepping motor. The thread, coming from the delivery mechanism, is thus hurled outwardly by the centrifugal force effect being produced and runs drawn within the compression chamber. The thread is placed arranged in an arc of a circle shape on the transporting device with a combination of centrifugal force and the thread's own weight. The depositing radius, which is influenced by the level of the centrifugal force, the thread's own weight and the speed of the conveyor belt, is adjusted to be so great here that the arc of a circle characteristic is still represented as virtually straight in the yarn tufts of the finished carpet.

According to another aspect of the device, the treatment device is a dyeing mechanism.

If the thread is to be continuously dyed, a corresponding device, which is known per se, can be arranged in the closed system. Once the thread has been drawn through a dye liquor and squeeze rollers, the depositing on the conveyor belt takes place.

Preferably, in the length compensating mechanism means for opening are arranged upstream of the compressed thread deposit produced during the shaping and depositing on the transporting mechanism and a control mechanism is provided, which ensures, taking into account the material-specific properties of the thread-like material, that delivery fluctuations of the thread-like material are compensated and the thread-like material is substantially uniformly drawn off to leave the system.

As, after setting, the thread should leave the system in a drawn manner for further processing, the thread must be brought into the drawn state. The drawing is produced by means of a length compensating mechanism, for example a loop store with a loading weight, whereby a thread tensile force is produced between the exit delivery mechanism and a binding point on the conveyor belt. The binding point on the conveyor belt can be defined by a freely rotatably mounted roller with a defined linear load, consisting of the roller weight plus optionally a spring. This roller forms a binding to the conveyor belt piece located in front of it, so that only the respective thread piece, which is currently running through the pressure line, is drawn by the weight in the loop store. In the case of an arc of a circle deposit in the case of the straight yarn production, a whole arc is always released. In the case of frieze yarns, the three-dimensional arc characteristic is drawn out. The yarn store is designed for the maximum thread length becoming free for both cases.

In the case of the weight store described, a permanent up and down movement thus takes place in the case of the straight yarn production owing to the length of a whole depositing arc becoming free in each case. The position of the loading weight is scanned by means of suitable sensors, preferably a contactless sensor system (for example Hall sensors or optical sensors). Sensors can be used here, which continuously detect the precise position over the entire possible movement stroke. A possible simple variant is a two-position detection, wherein suitable software, on reaching the lower sensor, can let the exit delivery mechanism run slightly faster and on reaching the upper sensor, can activate the exit delivery mechanism more slowly. Depending on the thread material and its shrink properties and the depositing behaviour or the occupation density on the belt, by adapting the control algorithms, the superimposed up and down movement can be compensated by the excess length being released behind the binding point in order to nevertheless ensure a utilisable control behaviour.

The unlooped or drawn yarn is then guided by means of the exit delivery mechanism to the exit sluice and drawn through the outlet thread sluice by means of a main draw-off arranged outside the system.

In accordance with a further feature, individual sub-systems form a structural unit and can be removed from the closed system.

The entire system can be configured as a modular system by means of the sub-systems. Individual sub-systems such as, for example, the treating device can thus be exchanged or removed from the entire system for maintenance purposes.

In a particular embodiment, a plurality of sub-systems are assembled together on a holder, such as, for example, a slide. This slide is located as whole in a housing, which is under compressed air, which substantially corresponds to the system pressure. This solution is advantageous because the entire unit can be pulled forward as a drawer for maintenance purposes and cleaning.

According to a further aspect of the device, the supply mechanisms are connected to a central supply.

In textile multi-station machines, it is advisable to realise the feed of the saturated steam and the compressed air centrally and to branch off therefrom the allocation as required to the individual workstations.

System parameters can be particularly preferably adjusted in the device.

The system parameters such as, for example, the delivery speeds, the conveyor belt speed, the rotational speed of the depositing tube, the air pressures and the temperatures can either be input at the central control unit or locally at the respective workstation computers.

Optionally, the system parameters also include the selection as to whether a frieze or straight effect is to be achieved and to what extent the frieze effect is formed. It is thus possible to adjust the system to material-specific special features and to thus be able to process the most varied materials.

Depending on the requirement profile, the system parameters can either be predetermined for the entire machine, for individual machine sides, for sections or individually for each workstation.

Means to automatically thread the thread-like material are also provided.

An automatic threading, for example by means of compressed air, is provided except for tube sluices, through which the thread preferably has to be drawn in manually.

The device can be integrated both in the thread run or thread production processes or thread processing processes or can be operated self-sufficiently. The device is particularly suitable for finishing carpet yarns. Therefore, the device according to the invention can, in particular, be integrated in the thread run of cabling or twisting machines. However, an arrangement, for example, in front of a tufting machine, in a spinning machine or downstream of an extruder or in another textile machine processing thread-like material would also be conceivable.

According to another feature, the device may be used for individual threads, but it is also possible for a thread sheet to be guided into the system to achieve an effect and the setting thereof.

In this case, a plurality of yarn sluices or, instead of the yarn sluices, corresponding, known separating means, such as, for example, squeeze rollers, are used for sealing.

BRIEF DESCRIPTION OF THE DRAWINGS

The invention will be described in more detail below with the aid of an embodiment shown in the drawings, wherein.

DETAILED DESCRIPTION OF THE INVENTION

Figure 1:
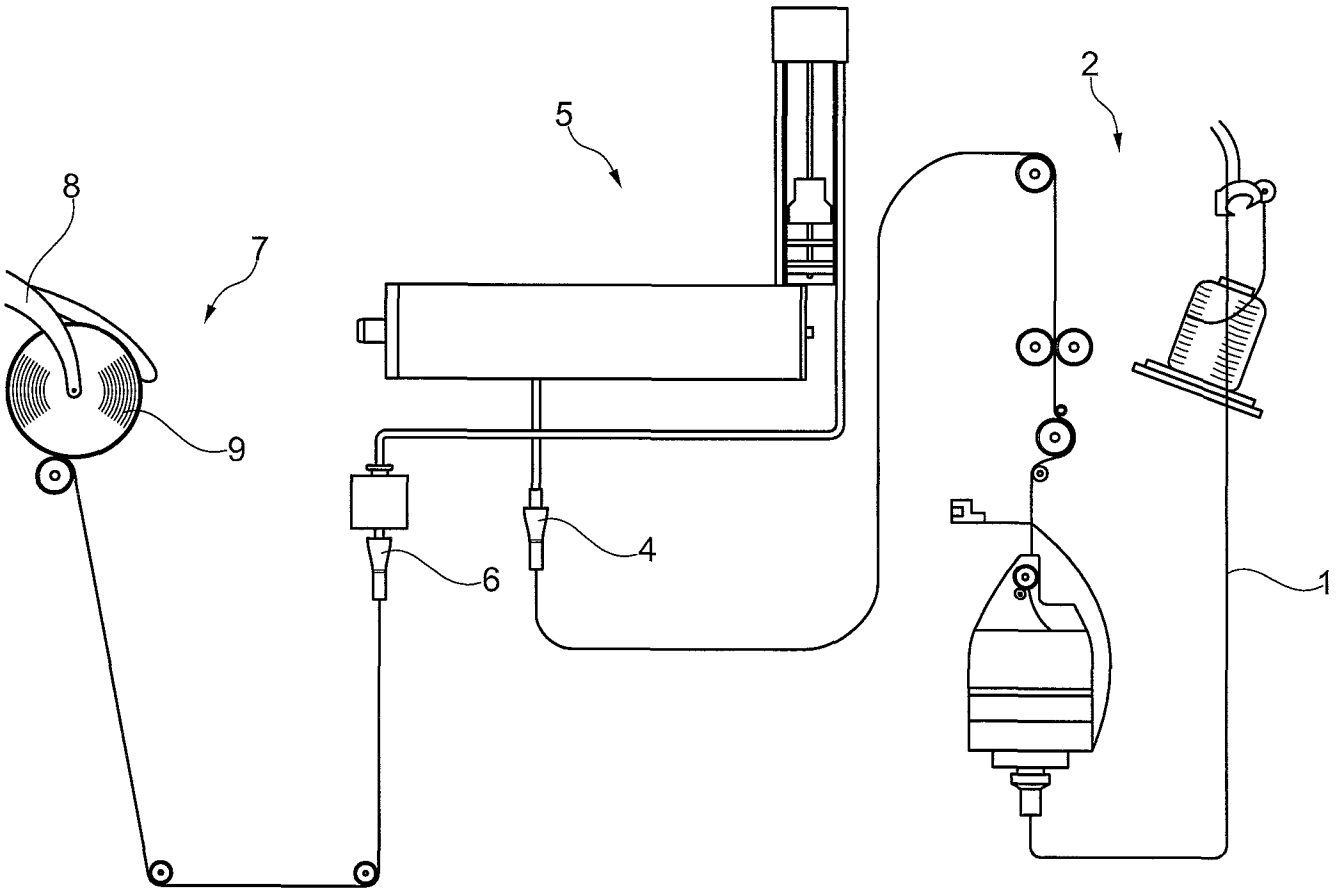
FIG. 1 shows a schematic view of the integration of the method according to the invention.

FIG. 1 shows, schematically and in a highly simplified manner, how the method according to the invention can be integrated into a thread production or thread processing process 2, the cabling or twisting process here. After the cabling/twisting 2, the thread 1 is transferred into the system 5 by an entry sluice 4. Once the desired effect has been given in the system 5 and has then been set, the thread 1 arrives through an exit sluice 6 back into the atmosphere in order to then be wound in the winding device 7 on the cross-wound bobbin 9 held by a creel 8.

This means that the thread 1 runs untreated into the system 5 and leaves the system completely finished.

Figure 2:
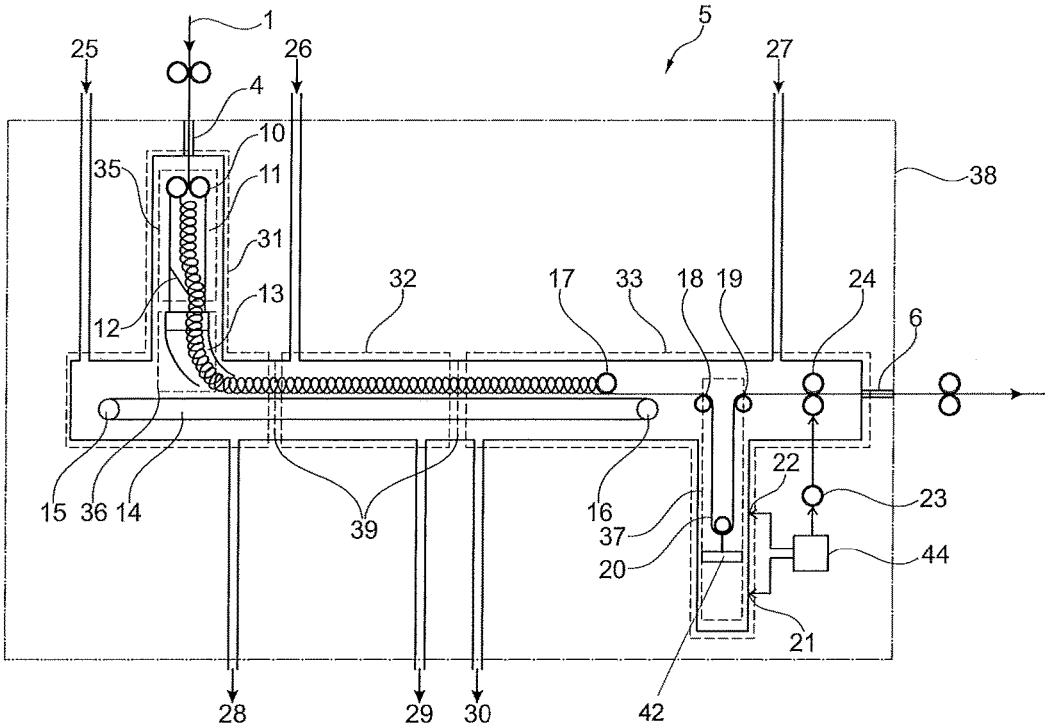
FIG. 2 shows a schematic view of the device according to the invention.

FIG. 2 schematically shows the device according to the invention. The system 5 is limited by housing 38.

A first sub-system is the compressed air zone 31 that is under system pressure, depending on the requirement, with an increased temperature as the preheating zone and optionally also a compressed air/steam mixture.

As a further sub-system, a combined frieze/straight set mechanism 35, which also works fully in the system pressure, is integrated therein.

The thread 1 is drawn via a delivery mechanism 10 through the entry sluice 4 into the system 5. The thread 1 is continuously conveyed into a compression chamber 11 and pressed at the exit against a spring-loaded retaining flap 12, which closes the exit of the compression chamber 11. Owing to the mechanical back pressure in the compression chamber 11, the thread is three-dimensionally bent and/or kinked (crimped) in a geometrically irregular manner. The thread sheet crimped in the compression chamber 11, also called a stuffer box, forms a thread plug against the force-loaded retaining flap 12, which, as soon as the plug pressure exceeds the counter-force of the retaining flap 12, leaves the compression chamber again. The level of the retaining flap resistance inter alia determines the intensity here of the three-dimensional forming formed in the plug, i.e. the intensity of the frieze character.

The next sub-system 36 ensures the controlled depositing on a transporting mechanism (for example a conveyor belt). From the compression chamber 11, the thread 1 runs through a depositing tube 13, the exit opening of which is fixed and points in the direction of the conveyor belt 14. The frieze yarn formed slips down under its own weight and as a result of the continuous replenishment in the interior of the depositing tube that is placed on the conveyor belt 14.

The sub-system of the steam zone 32 follows this. The deposited thread 1 runs at a defined speed on the conveyor belt 14 through a separating point 39 and arrives in the steam zone 32. The heating to the so-called thermosetting temperature or bulking temperature takes place there, in practice generally by means of saturated steam or overheated steam. In the process, the thread undergoes a shrinkage and bulking caused by the material.

To stabilise the steam zone 32, corresponding mechanical separating elements 39, a slotted screen here, are provided. Moreover, the upstream compressed air zone 31 or downstream cooling zone 33 is loaded with compressed air and a pressure substantially corresponding to the steam pressure. Both ensure a low media exchange between the individual zones.

In the following sub-system cooling zone 33, the thread 1 is cooled by compressed air to below the material-specific glass transition temperature so that the state present in the steam zone 32 is permanently stabilised or set and therefore becomes resistant to mechanical loads in the following processes, such as, for example, winding, tufting or weaving and in the finished carpet.

As the thread 1 is then to leave the system 5 drawn for further processing and winding on a bobbin, the thread 1 has to be brought again into the drawn state. The drawing is produced by a loop store 20 with a loading weight 42, so a thread tensile force is produced between the exit delivery mechanism 24 and a binding point on the conveyor belt 14.

A permanent up and down movement takes place in the thread or loop store 20, in the case of the straight set yarn production by the length of an entire depositing arc being released in each case. The position of the loading weight 42 is scanned by means of suitable Hall sensors 21, 22. By means of a two-position detection, the draw-off delivery mechanism 24 is activated, the controller 44, on reaching the lower sensor 21, allowing the draw-off delivery mechanism 24 to run slightly faster and activating the draw-off delivery mechanism 24 more slowly on reaching the upper sensor 22.

The thread 1, which is now delooped, is then guided by means of the exit delivery mechanism 24 to the exit sluice 6 and drawn through by means of a main draw-off.

The system 5 is supplied by means of the inlet for compressed air 25, the inlet for saturated steam 26 and the inlet for compressed air for the cooling zone 27. Together with the outlet for air 28, the outlet for steam/condensate 29 and the outlet for air from the cooling zone 30, a continuous supply to and disposal from the system 5 are ensured.

As a particular feature, the depositing tube 13 has a drive (not shown), for example a stepping motor. When straight set yarn is produced, in the sub-system effect production 35, the retaining flap 12, which is attached by a joint to the wall of the compression chamber 11, is placed in the rear position and remains there for the entire production time. The compression chamber 11 has thus become an obstacle-free guide for the thread 1 that is running through. At the same time, the depositing tube 13 is rotatably driven. The thread 1, coming from the delivery mechanism 10, is hurled outwardly by the centrifugal force effect being produced and runs in a drawn manner within the compression chamber 11. With the combination of centrifugal force and the thread 1's own weight, the thread 1 is placed on the conveyor belt 14 arranged in the form of an arc of a circle. The depositing radius, which is influenced by the level of the centrifugal force, the thread 1's own weight and the conveyor belt speed, is adjusted here to be so large that the arc of a circle characteristic is still represented as almost straight in the yarn tufts of the finished carpet.

In this manner, a change from the production of frieze yarn to straight set yarn is possible without changing mechanical components and without rethreading the yarn.

Figure 3:
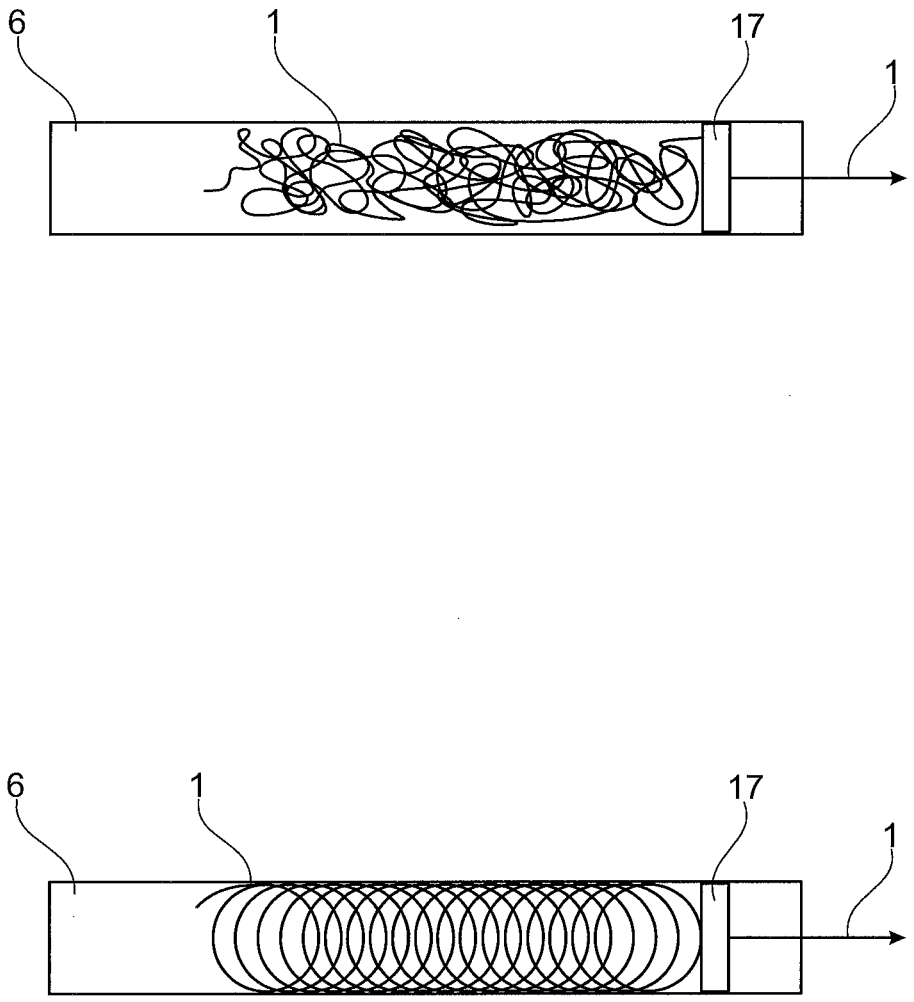
FIG. 3 shows a schematic view of the thread deposit for the combined frieze/straight set mechanism.

As can be seen in more detail from FIG. 3, the binding point on the conveyor belt 14 is defined with a freely rotatably mounted binding roller 17 with a defined linear load. This binding roller 17 forms a binding to the conveyor belt piece 14 located in front of it, so only the respective thread piece, which is currently running through the pressure line, is drawn by the weight 42 in the loop store 20. With an arc of a circle deposit in the case of the straight set yarn production, a whole arc is always released. In the case of frieze yarns, the three-dimensional arc characteristic is drawn out. The thread store 20 is designed for the maximum thread length being released in both cases.

Figure 4:
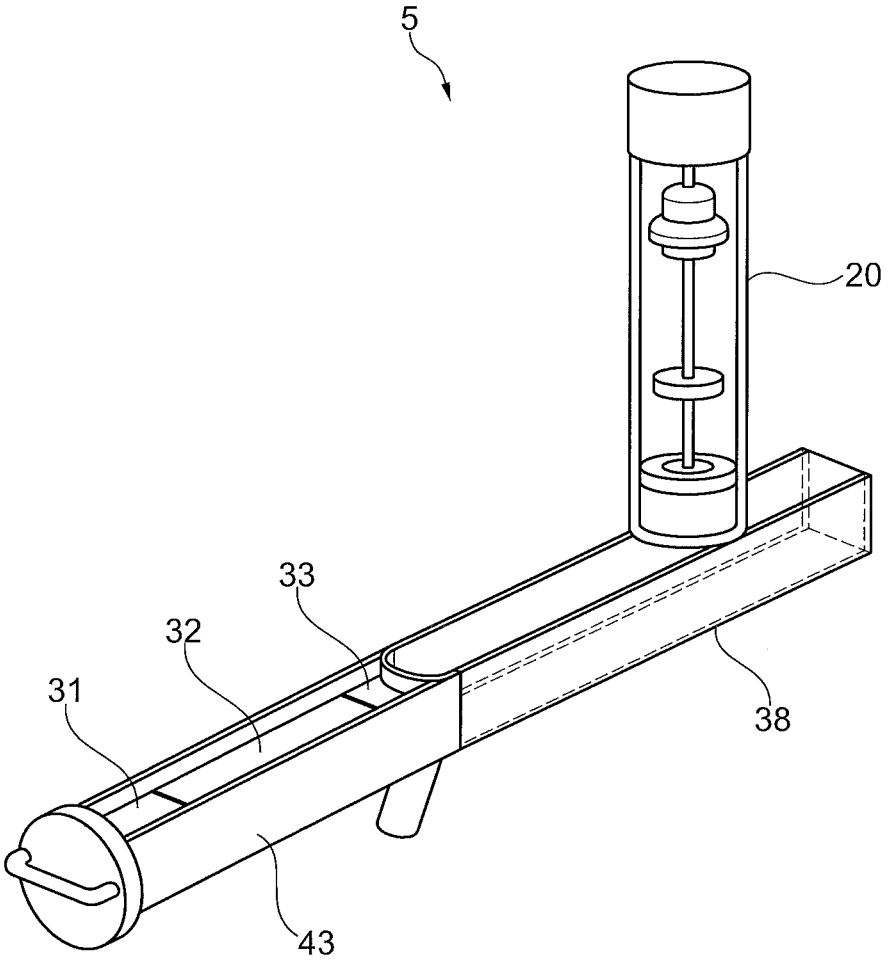
FIG. 4 shows a schematic view of the tube-in-tube variant.

FIG. 4 shows the device according to the invention with a plurality of sub-systems, including the sub-system compressed air zone 31, the sub-system steam zone 32 and the sub-system cooling zone 33, which are assembled together on a slide 43; the thread store 20 is also encompassed by the housing. The slide 43 is located as a whole in a housing 38 under compressed air. Thus, the entire system 5 can be drawn forward as a drawer for maintenance purposes and cleaning and, depending on requirement, the corresponding sub-system 31, 32, 33 or the corresponding sub-systems 31, 32, 33 can be removed. In this manner, moreover, no pressure difference acts on the wall of the steam zone 32, which allows substantially smaller wall thicknesses in the structural design for the zones 31, 32, 33. Only the housing 38 then has to be adapted with respect to its stability to the pressure difference of the ambient atmosphere from the internal system pressure.

The present invention has been herein described in relation to an exemplary embodiment or embodiments for purposes of providing an enabling disclosure of the invention. However, it will be understood by persons skilled in the relevant art that the present invention is susceptible of a broader utility and application. Accordingly, it is to be expressly understood that the present invention is not to be construed as limited to the embodiments, features and aspects herein described, but only according to the appended claims.

What is claimed is:

1. Device for continuously processing a thread-like material (1), comprising a common closed system (5) containing a plurality of sub-systems which include a feed mechanism (10), a treating device (35), a depositing device (36), a transporting device (14), a thermosetting mechanism (32) and a length compensating mechanism (37) arranged in the common closed system (5) and wherein the closed system (5) comprises supply mechanisms (25, 26, 27) for imposing a consistent prevailing interior pressure within the plurality of sub-systems different from the ambient environment surroundings the closed system and in that predetermined sub-systems (31, 32, 33, 35, 36, 37) that are shielded from one another within the system (5) for executing a plurality of respective processing steps, and the supply mechanisms (25, 26, 27) are connected to the predetermined sub-systems (31, 32, 33, 35, 36, 37) for producing at least partially different temperatures in the sub-systems (31, 32, 33, 35, 36, 37).

2. Device according to claim 1, characterised in that the system (5) comprises limits at which the thread-like material (1) enters or exits, the limits being formed by sluices (4, 6) which suppress a pressure compensation with the ambient environment and the sub-systems comprises respective limits (39) at which temperature shields are disposed.

3. Device according to claim 1, characterised in that the treating device (35) is a shaping mechanism.

4. Device according to claim 3, characterised in that the treating device (35) is a combined device for producing a frieze effect or alternatively a straight set effect.

5. Device according to claim 1, characterised in that the treating device (35) is a dyeing mechanism.

6. Device according to claim 1, characterised in that a device for opening a compressed thread deposit produced by the depositing device (35) on the transporting device (14) is arranged upstream of the length compensating mechanism (37).

7. Device according to claim 1, characterised in that the length compensating mechanism (37) comprises is a control mechanism, which, taking into account material-specific properties of the thread-like material (1), ensures that delivery fluctuations of the thread-like material (1) are compensated and draw-off of the thread-like material (1) to leave the system (5) takes place substantially uniformly.

8. Device according to claim 1, characterised in that individual sub-systems (31, 32, 33, 35, 36, 37) form a structural unit and can be removed from the closed system (5).

9. Device according to claim 1, characterised in that the supply mechanisms are connected to a central supply.

10. Device according to claim 1, characterised in that system parameters can be adjusted.

11. Device according to claim 1, characterized further by a device for automatically threading the thread-like material (1).

12. Device according to claim 1, characterised in that the system is a part of a thread run of a cabling or twisting machine.

13. Device according to claim 12, characterised in that the system is operable independently of the cabling or twisting machine.

14. Device according to claim 1, characterised in that the system is set up to process individual threads.

15. Device according to any claim 1, characterised in that the system is set up for processing a thread sheet.

* * * * *